US007736414B1

(12) United States Patent
Zinn

(10) Patent No.: US 7,736,414 B1
(45) Date of Patent: Jun. 15, 2010

(54) RHENIUM NANOPARTICLES

(75) Inventor: Alfred A. Zinn, Palo Alto, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 278 days.

(21) Appl. No.: 11/798,529

(22) Filed: May 15, 2007

Related U.S. Application Data

(60) Provisional application No. 60/800,855, filed on May 17, 2006.

(51) Int. Cl.
*B22F 9/22* (2006.01)

(52) U.S. Cl. ..... 75/369; 75/371

(58) Field of Classification Search ..... None
See application file for complete search history.

(56) References Cited

U.S. PATENT DOCUMENTS

| | | | | |
|---|---|---|---|---|
| 3,816,491 | A | 6/1974 | Wilkinson et al. | |
| 6,346,189 | B1 | 2/2002 | Dai et al. | |
| 6,660,058 | B1 * | 12/2003 | Oh et al. | 75/351 |
| 2004/0087441 | A1 * | 5/2004 | Bock et al. | 502/313 |
| 2004/6253174 | | 12/2004 | Williams | |
| 2005/0129580 | A1 | 6/2005 | Swinehart et al. | |
| 2006/0083694 | A1 | 4/2006 | Kodas et al. | |
| 2007/0031722 | A1 * | 2/2007 | Adzic et al. | 429/44 |
| 2007/0269991 | A1 | 11/2007 | Jang et al. | |
| 2008/0044657 | A1 | 2/2008 | Woo et al. | |
| 2009/0029148 | A1 * | 1/2009 | Hashimoto et al. | 428/323 |

FOREIGN PATENT DOCUMENTS

| | | | |
|---|---|---|---|
| WO | WO 2005/065100 | A2 | 7/2005 |
| WO | WO 2009/085342 | A1 | 7/2009 |

OTHER PUBLICATIONS

Ding et al., "Nucleation and Growth of Single-Walled Carbon Nanotubes: A Molecular Dynamics Study", J. Phys. Chem. B, (2004), pp. 17369-17377, vol. 108, American Chemical Society.

Öncel et al., "Carbon Nanotube Synthesis via the Catalytic CVD Method: A Review on the Effect of Reaction Parameters", Fullerenes, Nanotubes, and Carbon Nanostructures, (2006), pp. 17-37, vol. 14, Taylor & Francis Group, LLC.

Ritschel et al., "Rhenium-Catalyzed Growth Carbon Nanotubes", J. Phys. Chem. C, (2007), pp. 8414-8417, vol. 111, American Chemical Society.

U.S. Appl. No. 60/529,665, filed May 12, 2005, Resasco et al.

* cited by examiner

*Primary Examiner*—George Wyszomierski
(74) *Attorney, Agent, or Firm*—McDermott Will & Emery LLP

(57) ABSTRACT

Rhenium nanoparticle mixtures and methods for making the same are provided. The rhenium nanoparticle mixture can be painted onto a surface to be coated and dried at low temperatures to form a gas-tight elemental rhenium coating. Moreover, the rhenium nanoparticle mixture can be used to join rhenium components and temperatures far lower than traditional welding techniques would require. The low temperature formation of rhenium coatings allows rhenium coatings to be provided on surfaces that would otherwise be uncoatable, whether because of their inability to withstand high temperatures (e.g., carbon/carbon composites, graphite, etc.), or because the high aspect ratio of the surface would prevent other coating methods from being effective (e.g., the inner surfaces of tubes and nozzles).

22 Claims, 11 Drawing Sheets

RHENIUM NANOPARTICLES

CROSS-REFERENCE TO RELATED APPLICATION

The present application claims the benefit of priority under 35 U.S.C. §119 from U.S. Provisional Patent Application Ser. No. 60/800,855 entitled "FORMATION OF NANOSTRUCTURED RHENIUM (RE) COATINGS," filed on May 17, 2006, the disclosure of which is hereby incorporated by reference in its entirety for all purposes.

STATEMENT REGARDING FEDERALLY SPONSORED RESEARCH OR DEVELOPMENT

Not applicable.

FIELD OF THE INVENTION

The present invention generally relates to rhenium nanoparticles and, in particular, relates to methods and systems for manufacturing rhenium nanoparticles, rhenium nanoparticle mixtures, methods for forming rhenium coatings and rhenium coatings.

BACKGROUND OF THE INVENTION

Advanced hot-gas control systems are being designed and tested with operating temperatures in excess of 3000° F. These operating temperatures preclude the use of many metals in the construction of the control systems. Rhenium ("Re"), however, has a melting point of about 3180° C. (5756° F.), and could therefore be used in structural applications at temperatures up to about 2000° C. (3632° F.), and when combined with iridium ("Ir"), at temperature up to about 2200° C. (3992° F.). Moreover, rhenium is chemically compatible with most solid propellants, (i.e., it does not oxidize or carburize in the presence thereof), and it can be coated to prevent these undesirable effects in liquid or gel propellant gases.

Rhenium components are, however, difficult to produce using metallurgical processes such as casting, forming, machining, and joining. Because of rhenium's high melting point, casting is impractical, and therefore powder metallurgy is the primary processes for producing rhenium plate or barstock. This process is labor intensive, expensive, and has a long lead time, as components made via powder metallurgy must go through multiple processing steps and heat treatments, followed by costly and laborious machining processes that require special equipment.

Additional drawbacks to using rhenium include its strong propensity for work hardening, which complicates the use of standard metal working processes that require significant levels of deformation. Joining for the most part is limited to electron beam welding and diffusion bonding.

SUMMARY OF THE INVENTION

The present invention solves the foregoing problems by providing a method for making rhenium nanoparticles that enjoy a wide range of uses. For example, a rhenium nanoparticle mixture can be painted onto a surface to be coated and dried at low temperatures to form a gas-tight elemental rhenium coating. Moreover, the rhenium nanoparticle mixture can be used to join rhenium components at temperatures far lower than traditional welding techniques would require. The low temperature formation of rhenium coatings allows rhenium coatings to be provided on surfaces that would otherwise be uncoatable, whether because of the temperature required to hot isostatic press ("HIP") a coating or because of the high aspect ratio of the surface (e.g., which would prevent chemical vapor deposition from being effective).

According to one embodiment of the present invention, a method for manufacturing rhenium nanoparticles comprises the steps of providing an ethylene oxide solvent, providing a rhenium precursor, the rhenium precursor including rhenium and one or more additional elements, providing a reactant for reacting with the rhenium precursor to free the rhenium from the one or more additional elements, providing a surfactant, and combining the rhenium precursor, the reactant and the surfactant in the ethylene oxide solvent to form a plurality of rhenium nanoparticles and to surround each rhenium nanoparticle with a layer of molecules of the surfactant.

According to another embodiment of the present invention, a method for manufacturing rhenium nanoparticles comprises the steps of providing an ethylene oxide solvent, reacting, in the ethylene oxide solvent, a rhenium precursor and a reactant to free a plurality of rhenium atoms from the rhenium precursor, combining, in the ethylene oxide solvent, the plurality of rhenium atoms to form a rhenium nanoparticle, and surrounding, in the ethylene oxide solvent, the rhenium nanoparticle with a layer of surfactant molecules.

According to another embodiment of the present invention, a rhenium nanoparticle mixture comprises a solvent and a plurality of rhenium nanoparticles, each of the plurality of rhenium nanoparticles being surrounded by a layer of surfactant molecules.

According to another embodiment of the present invention, a method for forming a rhenium coating comprises a providing step of providing a rhenium nanoparticle mixture, the rhenium nanoparticle mixture including a solvent and a plurality of rhenium nanoparticles, each of the plurality of rhenium nanoparticles being surrounded by a layer of surfactant molecules, a disposing step of disposing the rhenium nanoparticle mixture on a surface to be coated, a first heating step of heating the rhenium nanoparticle mixture to a first temperature to evaporate the solvent and leave the plurality of rhenium nanoparticles surrounded by surfactant molecules on the surface, a second heating step of heating the rhenium nanoparticles and the surfactant molecules to a second temperature to remove the surfactant molecules and leave the plurality of rhenium nanoparticles on the surface and a third heating step of heating the rhenium nanoparticles to a third temperature to bond the rhenium nanoparticles to form a coating on the surface.

According to another embodiment of the present invention, a method for rhenium welding comprises the steps of providing a first rhenium surface, coating the first rhenium surface with a rhenium nanoparticle mixture, the rhenium nanoparticle mixture including a solvent and a plurality of rhenium nanoparticles, each of the plurality of rhenium nanoparticles being surrounded by a layer of surfactant molecules, coupling a second rhenium surface to the coated first rhenium surface to form a joint, heating the joint to a first temperature to evaporate the solvent, heating the joint to a second temperature to remove the surfactant molecules, and heating the joint to a third temperature to bond the rhenium nanoparticles to the first rhenium surface and the second rhenium surface.

According to another embodiment of the present invention, a method for manufacturing nanoparticles is provided. The method comprises the steps of providing an ethylene oxide solvent, providing a precursor including one or more of rhenium and iridium, and further including one or more additional elements other than rhenium and iridium, providing a reactant for reacting with the precursor to remove the one or more additional elements, providing a surfactant, and combining the precursor, the reactant and the surfactant in the ethylene oxide solvent to form a plurality of nanoparticles and to surround each nanoparticle with a layer of molecules of the surfactant.

It is to be understood that both the foregoing summary of the invention and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail to avoid unnecessarily obscuring the present invention.

Figure 1:
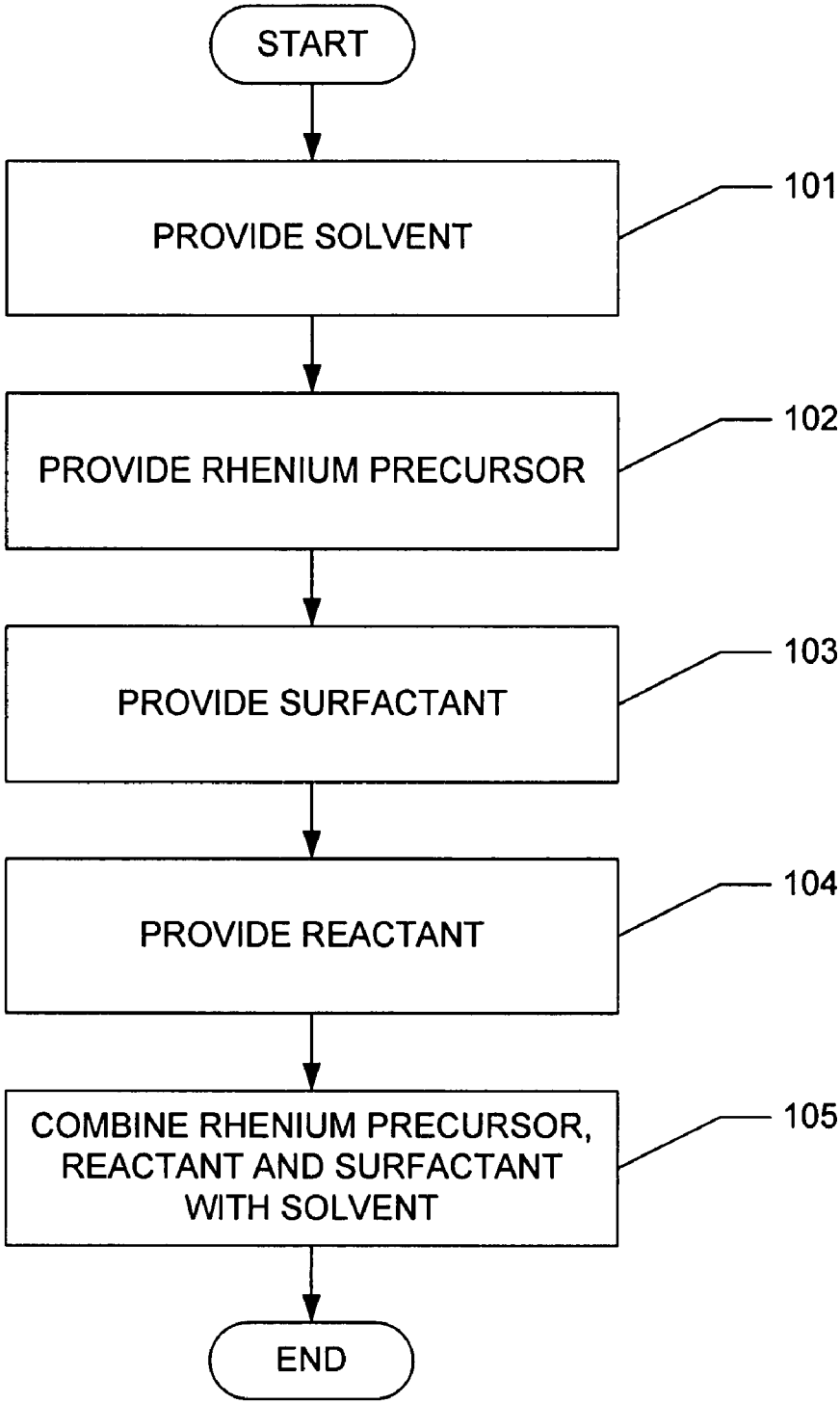
FIG. 1 is a flowchart illustrating a method for manufacturing rhenium nanoparticles in accordance with one embodiment of the present invention.

FIG. 1 is a flowchart illustrating a method for manufacturing rhenium nanoparticles in accordance with one embodiment of the present invention. In step 101, an ethylene oxide solvent is provided. In accordance with various aspects of the present invention, the solvent may be monoglyme $CH_3—O—CH_2CH_2—O—CH_3$, diglyme $CH_3—O—(CH_2CH_2—O)_2—CH_3$, triglyme $CH_3—O—(CH_2CH_2—O)_3—CH_3$, or any other glyme characterized by the chemical formula $CH_3—O—(CH_2CH_2—O)_x—CH_3$, where x is a positive integer. In step 102, a rhenium precursor including rhenium and one or more additional elements is provided. For example, in accordance with one embodiment of the present invention, the rhenium precursor is rhenium (V) chloride ($ReCl_5$). In step 103, a surfactant is provided. The surfactant may be an organic amine, phosphine, acid or the like. For example, in the present exemplary embodiment, the surfactant may be n-hexylamine ($CH_3(CH_2)_5NH_2$), n-nonylamine ($CH_3(CH_2)_8NH_2$), n-dodecylamine ($CH_3(CH_2)_{11}NH_2$), or any other amine characterized by the chemical formula $CH_3(CH_2)_xNH_2$, where x is a positive integer. In step 104, a reactant capable of reducing the rhenium in the rhenium precursor to its atomic form is provided. For example, in the present exemplary embodiment, the reactant may be $NaBH_4$, $LiBH(Et)_3$, or any other reactant capable of reducing rhenium (V) chloride. In other embodiments in which other rhenium precursors are used, additional reactants may be used.

In step 105, the rhenium precursor, the reactant and the surfactant are combined in the ethylene oxide solvent to initiate a chemical reaction which forms rhenium nanoparticles, each of which is surrounded by a layer of molecules of the surfactant. For example, in the present exemplary embodiment, in which the rhenium precursor is rhenium (V) chloride ($ReCl_5$), the reactant is sodium borohydride ($NaBH_4$), and the surfactant is n-hexylamine ($CH_3(CH_2)_5NH_2$), the reaction proceeds as follows. Initially, the reactant and the rhenium precursor react to free elemental rhenium from the precursor, as illustrated in Equation 1, below:

$$ReCl_5+5NaBH_4 \rightarrow Re_{metal}+5NaCl+2.5B_2H_6+2.5H_2 \quad (1)$$

The sodium chloride (NaCl) precipitates out of the solution, and the hydrogen ($H_2$) and diborane ($B_2H_6$) gases are boiled off, while the free atoms of $Re_{metal}$ rapidly coalesce to form rhenium nanoparticles. The free electrons in the $NH_2$ end of the n-hexylamine ($CH_3(CH_2)_5NH_2$) surfactant molecules in the solvent are drawn to and form bonds with the dangling bonds (i.e., the unsaturated bonding orbitals) of the outermost rhenium atoms in the rapidly growing rhenium nanoparticles, such that the surfactant molecules form a protective barrier around the nanoparticles which prevents their further growth. In this fashion, the reaction is halted before the rhenium nanoparticles have had a chance to further coalesce into a larger mass.

According to one aspect of the present invention, the order in which the reagents are combined is important for ensuring a narrow size distribution of rhenium nanoparticles. For example, when both the surfactant and the rhenium precursor are added to the solvent (and thoroughly distributed therein) before the reactant is added thereto, local differences in the concentration of the rhenium precursor and the surfactant can be avoided. This equilibrium ensures that the when the reactant is added, the rhenium nanoparticles that form will form in a similar manner and achieve similar sizes.

Moreover, the speed with which the reactant is added to the reaction is important for ensuring a narrow size distribution of rhenium nanoparticles, in accordance with one embodiment of the present invention. By slowly adding the reactant (e.g., at a rate of about 50 to 60 drops per minute), local differences in the concentration of the reactant can similarly be avoided, to ensure that the rhenium nanoparticles form in near-equilibrium conditions and achieve similar final sizes. Alternatively, by more quickly adding the reactant (e.g., at a rate greater than 100 drops per minute), a larger particle size distribution can be achieved (e.g., due to the local concentration differences that occur). In accordance with one embodiment of the present invention, reactant can be slowly added until nearly all of the rhenium precursor has been consumed, at which time a surplus of reactant (i.e., more than is needed to react with all of the rhenium precursor) is quickly added to ensure that all the remaining rhenium precursor is reacted with. This approach offers the advantage of ensuring that nearly all of the rhenium nanoparticles will achieve a similar size, while also ensuring that all of the rhenium precursor is consumed.

While in the foregoing exemplary embodiment, the surfactant used to prevent further rhenium nanoparticle growth is n-hexylamine, the scope of the present invention is not limited to this arrangement. Rather, as will be apparent to one of skill in the art, any one of a number of polar surfactant molecules with free electrons or electron pairs may be used as a surfactant with rhenium nanoparticles. Moreover, while in the foregoing exemplary embodiment, only one surfactant was used, the present invention has application to reactions in which multiple surfactants are used to control the growth of rhenium nanoparticles. For example, the surfactant(s) used may be any one or more surfactants chosen from the illustrative list in Table 1, below:

TABLE 1

| Surfactant Type | Representative List |
|---|---|
| Organic amine | Pyridine<br>Triethanol amine<br>Diethylene triamine<br>Ethylene diamine (C2 to C16)<br>Hexyl-, nonyl-, Dodecyl amine (C6 to C16) |
| Organic amine halide salt | Hexyl-nonyl-, Hexadecyl ammonium chloride (C6 to C16)<br>Hexyl-nonyl-, Hexadecyl ammonium boride (C6 to C16) |
| Organic alcohol | Octanol, decanol, dodecanol (C6 to C16) |
| Organic acid | C2 to C16: Acetic acid, Hexanoic acid<br>Oleic acid (cis-9-octadecenoic acid) |
| Organic phosphines/ phospine oxides | Tri-phenyl phosphine<br>Tri-ethyl phosphine oxide<br>C1 to C10 |
| Organic nitrile | Acetonitrile<br>Benzonitrile<br>C2 to C16 |

In accordance with one aspect of the present invention, as some strong reducing agents (e.g., $NaBH_4$, $LiAlH_4$, etc.) can and do react with organic nitriles, they should therefore not be used during the initial rhenium nanoparticle formation, but these can later be exchanged for, e.g., saturated amines.

In accordance with one important aspect of the present invention, the length of the carbon chain of the surfactant molecule plays an important role in determining the amount of protection given the rhenium nanoparticle. For straight, single hydrocarbon chain systems, chains shorter than C6 do not bond sufficiently with the nanoparticle to protect it, as little thermal energy is required to cause these molecules to come off For chains longer than C16, the surfactant material is increasingly difficult to remove, which will make forming rhenium coatings increasingly difficult, as is described in greater detail below. In general, amines bond more strongly to rhenium nanoparticles than do alcohols, as the former exhibit higher Lewis Base strength, due to their ability to establish a higher covalent bond character.

While the foregoing exemplary embodiment has been described with reference to $ReCl_5$ reacting with either $NaBH_4$ or $LiBH(Et)_3$, the scope of the present invention is not limited to this particular rhenium precursor and these particular reactants. Rather, the present invention has application to reactions for forming rhenium nanoparticles which utilize any rhenium precursor and any reactant capable of freeing elemental rhenium from that precursor.

Figure 2:
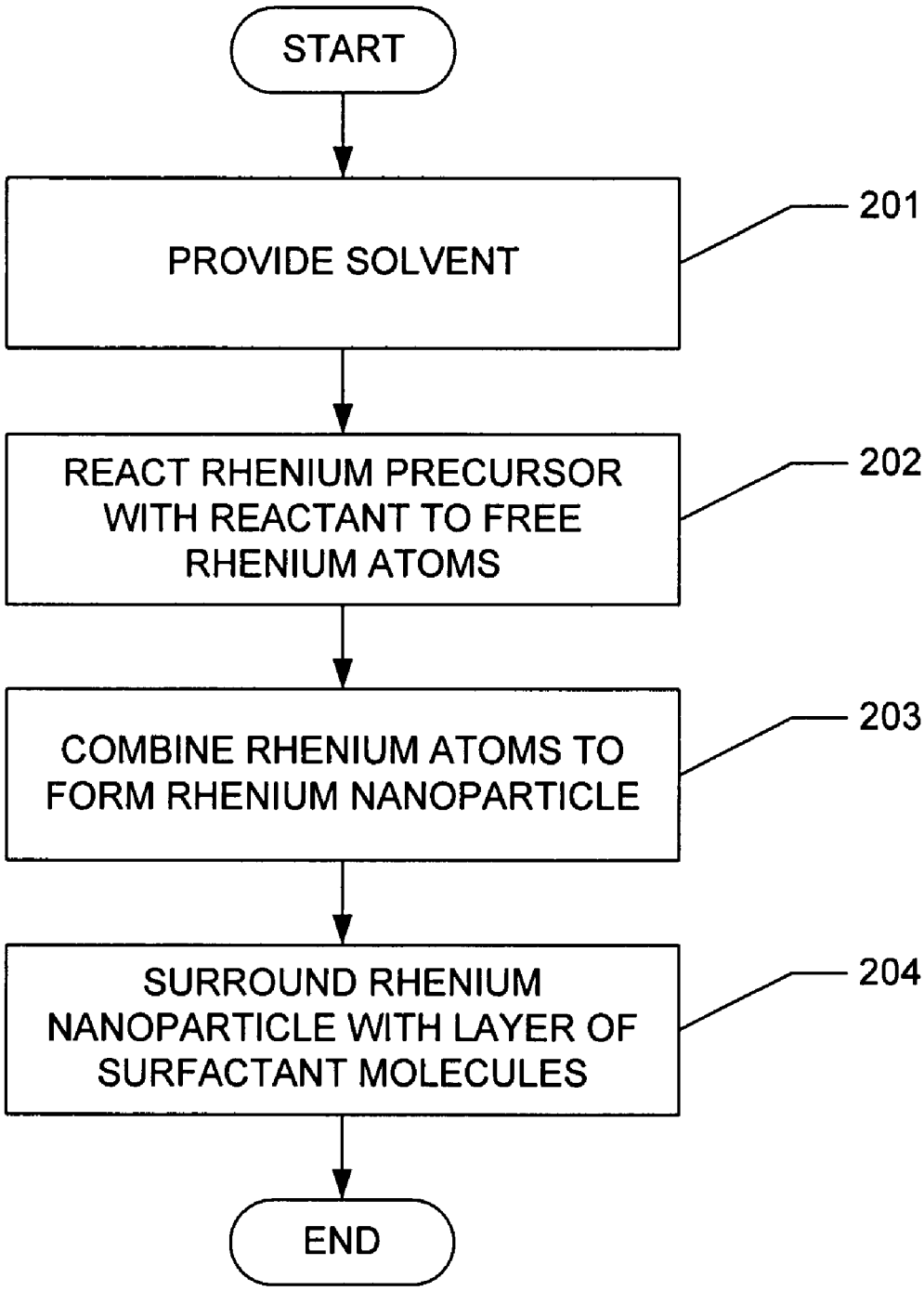
FIG. 2 is a flowchart illustrating a method for manufacturing rhenium nanoparticles in accordance with one embodiment of the present invention.

FIG. 2 is a flowchart illustrating a method for manufacturing rhenium nanoparticles in accordance with another embodiment of the present invention. In step 201, an ethylene oxide solvent, such as monoglyme $CH_3—O—CH_2CH_2—O—CH_3$, diglyme $CH_3—O—(CH_2CH_2—O)_2—CH_3$, triglyme $CH_3—O—(CH_2CH_2—O)_3—CH_3$, or any other glyme characterized by the chemical formula $CH_3—O—(CH_2CH_2—O)_x—CH_3$, where x is a positive integer, is provided. In step 202, a rhenium precursor and a reactant are reacted in the ethylene oxide solvent to free rhenium atoms from the precursor. The byproducts of this reaction are precipitated out of solution or boiled off. In step 203, the rhenium particles are combined in the ethylene oxide solvent to form a rhenium nanoparticle. In step 204, the rhenium nanoparticle is surrounded, in the ethylene oxide solvent, with a layer of surfactant molecules. The surfactant molecules, which are provided in the solvent at the beginning of the reaction, may be n-hexylamine ($CH_3(CH_2)_5NH_2$), n-nonylamine ($CH_3(CH_2)_8NH_2$), n-dodecylamine ($CH_3(CH_2)_{11}NH_2$), or any other amine characterized by the chemical formula $CH_3(CH_2)_xNH_2$, where x is a positive integer.

Figure 3:
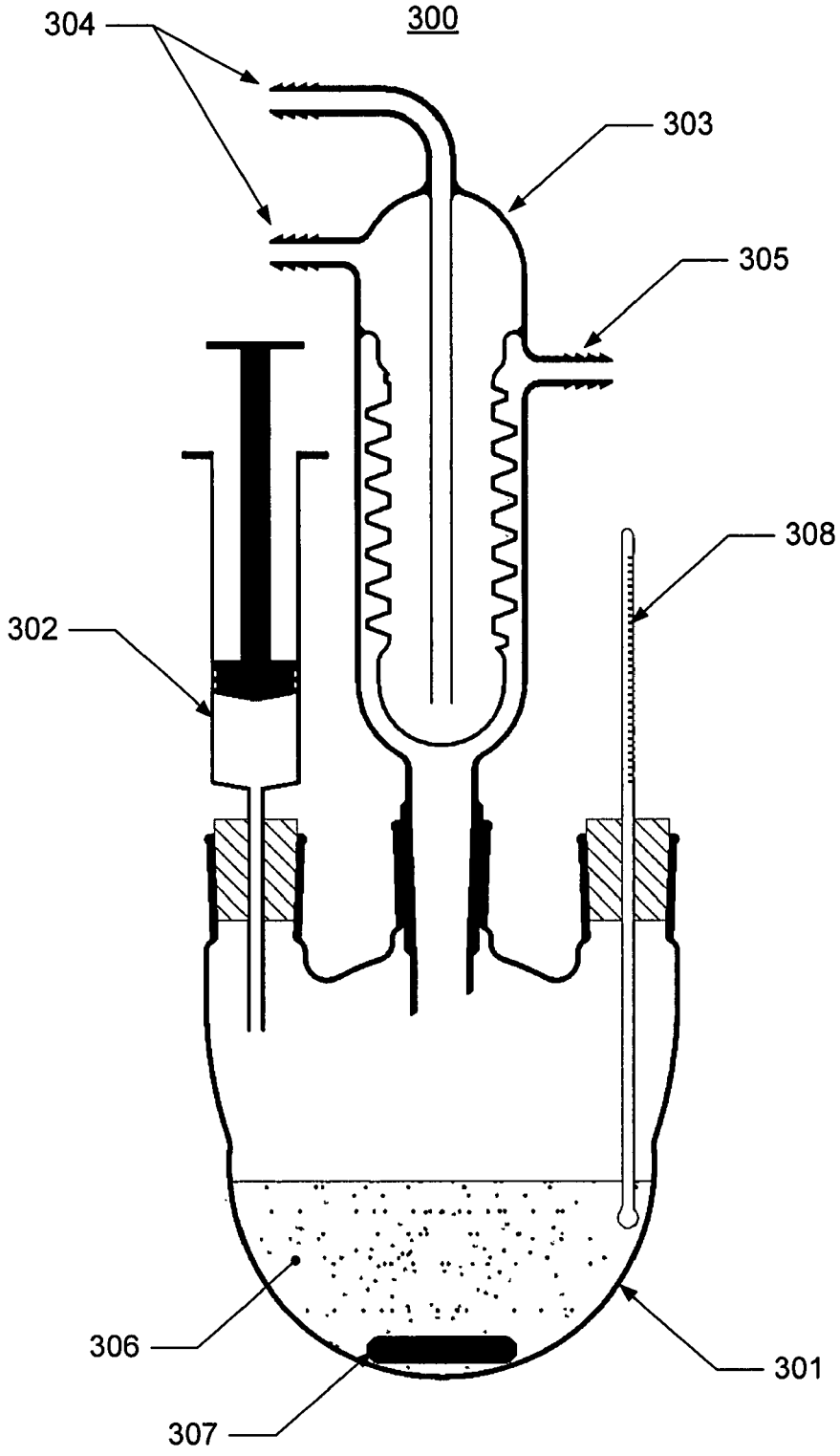
FIG. 3 illustrates a reactor used in the manufacture of rhenium nanoparticles in accordance with one embodiment of the present invention.

Turning to FIG. 3, a reactor system used in the manufacture of rhenium nanoparticles is illustrated in accordance with one embodiment of the present invention. Reactor system 300 includes a continuous stirred-tank reactor 301, into which reagents 306 are provided via a syringe or an addition funnel 302. An impeller 307 stirs the reagents 306 to ensure thorough mixing thereof (e.g., to optimize the particle size distribution of the rhenium nanoparticles). A condenser 303 allows gases created in the chemical reactions occurring in reactor 301 (e.g., hydrogen and diborane in the present exemplary embodiment) to escape through outlet 305, while coolant which flows through ports 304 through condenser 303 cools more volatile species (such as the surfactant or the solvent) and allows them to trickle back down along the corkscrew-shaped path in condenser 303 into reactor 301. A thermometer 308 is used to track the temperature of the reagents 306 during the chemical reaction. System 300 may further include a heat source (not illustrated) to increase the temperature of the reaction, and thereby control the size and size distribution of the rhenium nanoparticles, as described in greater detail below.

According to one aspect of the present invention, reactor 301 can be heated (or cooled) to control the temperature at which the reactions therein take place. The duration for which heat is applied provides a mechanism for ensuring even distribution of the reagents during the reaction and thorough mixing thereof, so that the size distribution of the rhenium nanoparticles can be narrowed. For example, in accordance with one aspect of the present invention, reactor 301 is heated for about 90 minutes after combining the solvent, rhenium precursor and surfactant therein to ensure an even distribution thereof.

According to another aspect of the present invention, the concentration of surfactant in the reaction can similarly modify the resultant size and size distribution of rhenium nanoparticles. With higher concentrations of surfactant, the rhenium nanoparticles are more likely to encounter and bond with surfactant molecules early in their growth, resulting in both smaller nanoparticles, and a smaller distribution of particle sizes.

While in the foregoing exemplary embodiments, the rhenium nanoparticles have been described with respect to particular sizes, the scope of the present invention is not limited to these particular arrangements. For example, by reducing the concentration of surfactant in the reaction or increasing the speed with which the reactant is added thereto, rhenium nanoparticles larger than 100 nm may be manufactured. Alternatively, by increasing the concentration of surfactant in the reaction, nanoparticles as small as 4 nm nay be manufactured. As will be apparent to one of skill in the art, the present invention has application to the manufacture of rhenium nanoparticles of nearly any size.

In accordance with one exemplary experimental embodiment of the present invention, 6.0-6.1 g of $ReCl_5$ were dissolved in 60 ml of triglyme, to which was added a solution of 6.30-6.90 g of dodecylamine in 60 ml of triglyme. This entire mixture was heated to 60-70° C. for 90 minutes to dissolve the $ReCl_5$. Next, 42-45 ml of a $NaBH_4$/triglyme solution (15 g in 200 ml) was added via an addition funnel at a rate of 50-60 drops per minute. The heat was removed after the addition of the $NaBH_4$ was completed, but stirring continued for 20-30 min. To isolate the rhenium nanoparticles, 120 ml of water was added to precipitate the nanoparticles, and the mixture was centrifuged to separate the nanoparticles from the supernatant containing the reaction side-products (e.g., NaCl). This cleaning step was repeated 3 to 5 times to remove all of the NaCl precipitate.

In accordance with another exemplary experimental embodiment of the present invention, 6.0-6.1 g of $ReCl_5$ were dissolved in 60 ml of triglyme, to which was added a solution of 7.80-8.50 g of dodecylamine in 60 ml of triglyme. This entire mixture was heated to 60-70° C. for 90 minutes to dissolve the $ReCl_5$. Next, 42-45 ml of a $NaBH_4$/triglyme solution (15 g in 200 ml) was added via an addition funnel at a rate of 50-60 drops per minute. The heat was removed after the addition of the $NaBH_4$ was completed, but stirring continued for 20-30 min. To isolate the rhenium nanoparticles, 120 ml of water was added to precipitate the nanoparticles, and the mixture was centrifuged to separate the nanoparticles from the supernatant containing the reaction side-products (e.g., NaCl). This cleaning step was repeated 3 to 5 times to remove all of the NaCl precipitate.

In accordance with yet another exemplary experimental embodiment of the present invention, 6.0-6.1 g of $ReCl_5$ were dissolved in 60 ml of triglyme, to which was added a solution of 6.30-6.90 g of dodecylamine in 60 ml of triglyme. This entire mixture was heated to 120-150° C. for 30-60 minutes to dissolve the $ReCl_5$. Next, 42-45 ml of a $NaBH_4$/triglyme solution (15 g in 200 ml) was added via an addition funnel at a rate of 50-60 drops per minute. The heat was removed after the addition of the $NaBH_4$ was completed, but stirring continued for 20-30 min. To isolate the rhenium nanoparticles, 120 ml of water was added to precipitate the nanoparticles, and the mixture was centrifuged to separate the nanoparticles from the supernatant containing the reaction side-products (e.g., NaCl). This cleaning step was repeated 3 to 5 times to remove all of the NaCl precipitate. The higher temperature used in this experiment did not appear to affect the size or size distribution of the rhenium nanoparticles produced thereby.

In accordance with yet another exemplary experimental embodiment of the present invention, 6.0-6.1 g of $ReCl_5$ were dissolved in 60 ml of triglyme, to which was added a solution of 7.80-8.50 g of dodecylamine in 60 ml of triglyme. This entire mixture was heated to 120-150° C. for 30-60 minutes to dissolve the $ReCl_5$. Next, 42-45 ml of a $NaBH_4$/triglyme solution (15 g in 200 ml) was added via an addition funnel at a rate of 50-60 drops per minute. The heat was removed after the addition of the $NaBH_4$ was completed, but stirring continued for 20-30 min. To isolate the rhenium nanoparticles, 120 ml of water was added to precipitate the nanoparticles, and the mixture was centrifuged to separate the nanoparticles from the supernatant containing the reaction side-products (e.g., NaCl). This cleaning step was repeated 3 to 5 times to remove all of the NaCl precipitate. The increased amount of dodecylamine used in this embodiment appeared to have a significant effect on the size and size distribution of the rhenium nanoparticles produced thereby, with the result being smaller particles in a narrower size distribution.

In accordance with yet another exemplary experimental embodiment of the present invention, 6.0-6.1 g of $ReCl_5$ were dissolved in 60 ml of triglyme, to which was added a solution of 6.30-6.90 g of dodecylamine in 60 ml of triglyme. This entire mixture was heated to 120-150° C. for 30-60 minutes to dissolve the $ReCl_5$. Next, 42 ml of a $NaBH_4$/triglyme solution (15 g in 200 ml) was added via an addition funnel at a rate of 50-60 drops per minute, with an additional 5 ml of the $NaBH_4$/triglyme solution being injected at the edge to fully react the remaining $ReCl_5$ rhenium precursor. The heat was removed after the addition of the $NaBH_4$ was completed, but stirring continued for 20-30 min. To isolate the rhenium nanoparticles, 120 ml of water was added to precipitate the nanoparticles, and the mixture was centrifuged to separate the nanoparticles from the supernatant containing the reaction side-products (e.g., NaCl). The extra "kick" of 5 ml of $NaBH_4$/triglyme solution appears to have narrowed the particle size distribution somewhat.

In accordance with yet another exemplary experimental embodiment of the present invention, 6.0-6.1 g of $ReCl_5$ were dissolved in 60 ml of triglyme, to which was added a solution of 5-30 ml of hexylamine in 60 ml of triglyme. This entire mixture was heated to 60-70° C. for 90 minutes to dissolve the $ReCl_5$. Next, 42-45 ml of a $NaBH_4$/triglyme solution (15 g in 200 ml) was added via an addition funnel at a rate of 50-60 drops per minute. The heat was removed after the addition of the $NaBH_4$ was completed, but stirring continued for 20-30 min. To isolate the rhenium nanoparticles, 120 ml of water was added to precipitate the nanoparticles, and the mixture was centrifuged to separate the nanoparticles from the supernatant containing the reaction side-products (e.g., NaCl). This cleaning step was repeated 3 to 5 times to remove all of the NaCl precipitate.

Figure 4:
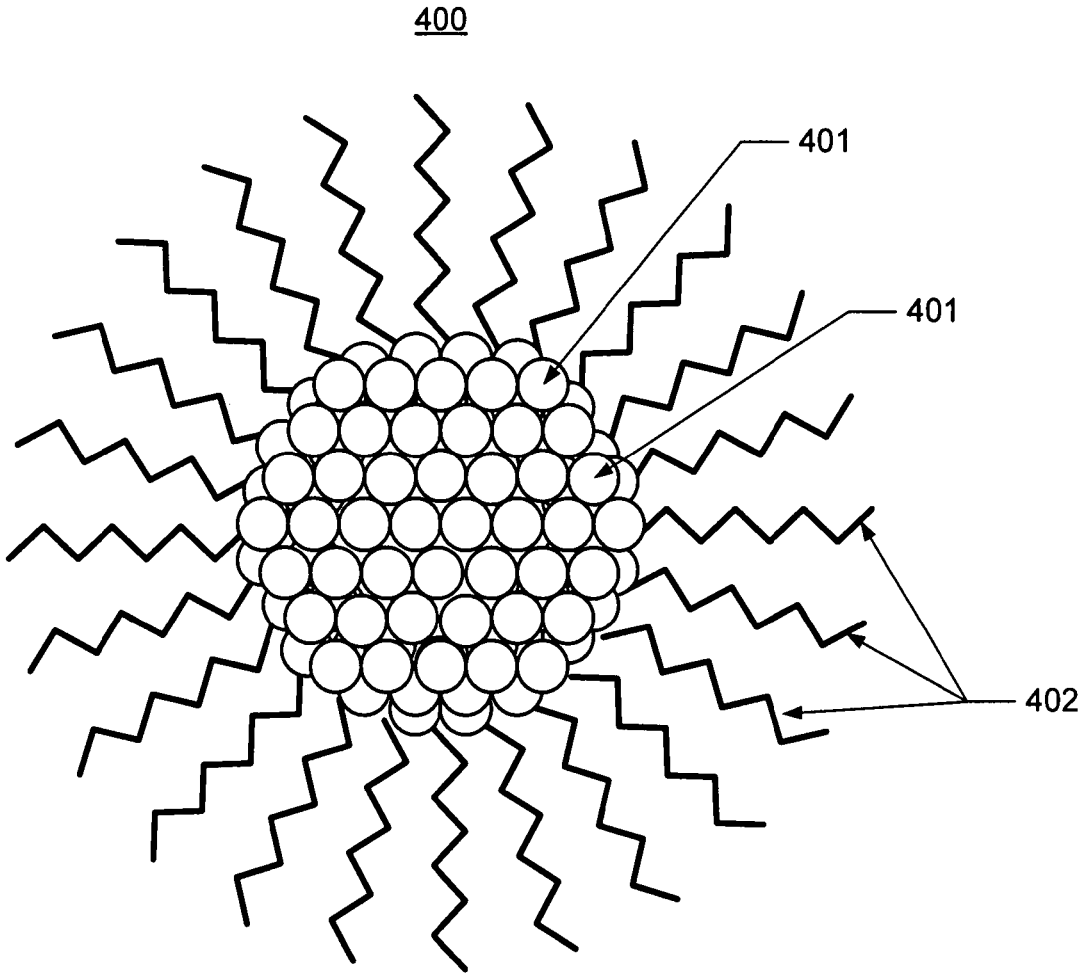
FIG. 4 illustrates a rhenium nanoparticle surrounded with surfactant molecules in accordance with one embodiment of the present invention.

FIG. 4 illustrates a single rhenium nanoparticle in greater detail, in accordance with one embodiment of the present invention. Rhenium nanoparticle 400 includes a plurality of rhenium atoms 401 tightly bonded together. Surrounding rhenium atoms 401 is a layer of surfactant molecules 402, in this case, n-hexylamine ($CH_3(CH_2)_5NH_2$). The $NH_2$ end of each n-hexylamine molecule has bonded with the dangling bonds (i.e., the unsaturated bonding orbitals) of the outermost rhenium atoms 401 in rhenium nanoparticle 400 to form a protective barrier around nanoparticle 400. While FIG. 4 illustrates a single particle in cross-section, showing only a ring of surfactant molecules at the periphery of the nanoparticle, an actual rhenium nanoparticle has a three-dimensional shell of surfactant molecules 402 surrounding the rhenium atoms 401 on all sides.

In accordance with one aspect of the present invention, surfactant molecules 402 need not be the same surfactant molecules used to stop rhenium nanoparticle 400 from growing during the manufacture thereof. Rather, as will be immediately understood by one of skill in the art, a simple ligand exchange may be used to replace some or all of the surfactant molecules which were used in the manufacture of rhenium nanoparticle 400.

Figure 5:
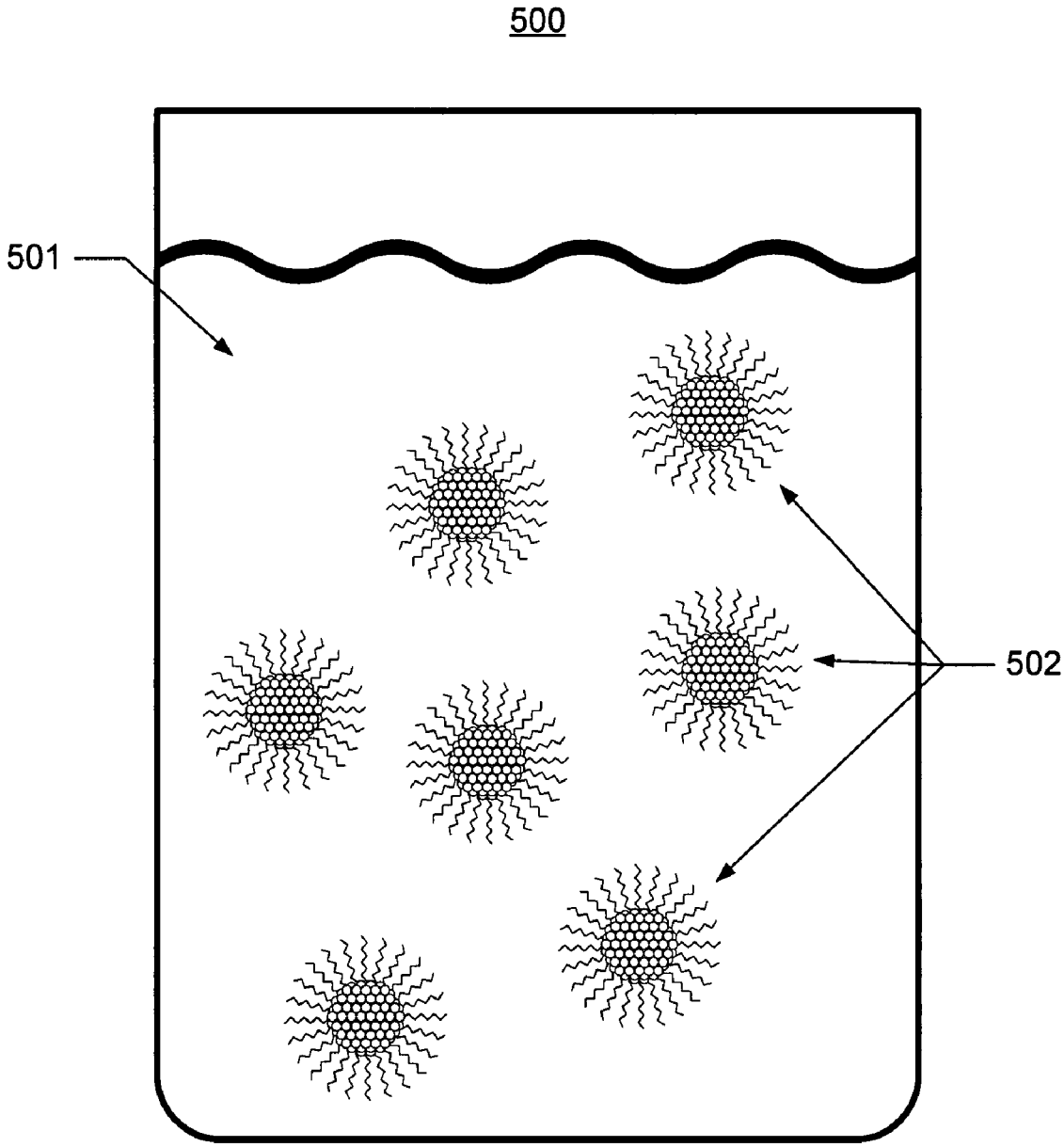
FIG. 5 illustrates a rhenium nanoparticle mixture in accordance with one embodiment of the present invention.

FIG. 5 illustrates a rhenium nanoparticle mixture in accordance with one embodiment of the present invention. Rhenium nanoparticle mixture 500 includes a solvent 501, in which are disposed a plurality of rhenium nanoparticles 502. The solvent 501 need not be the same ethylene oxide solvent used in the manufacturing process of rhenium nanoparticles 502. Rather, different solvents may be used in nanoparticle mixture 500 depending upon whether nanoparticle mixture 500 is to be used to coat a surface, as described in greater detail below, or whether nanoparticle mixture 500 is being stored. For example, in the present exemplary embodiment of the present invention, solvent 501 is hexane $CH_3(CH_2)_4CH_3$, a solvent with a low boiling point (~0.69° C.), suitable for use in the rhenium nanoparticle coating processes described in greater detail below. Each rhenium nanoparticle 502 is surrounded by a layer of surfactant molecules which form a protective barrier around the nanoparticle, preventing it from chemically reacting with other substances, such as air or moisture. This protective layer of surfactants around each nanoparticle 502 allows mixture 500 to be handled with relative safety (e.g., as the pyrophoricity of the rhenium nanoparticles is negated thereby).

In accordance with various aspects of the present invention, depending upon their size, rhenium nanoparticles 502 may either be dissolved in solvent 501, or may alternately form a slurry therewith. For example, in hexane, rhenium nanoparticles smaller than 10 nm will dissolve, while those larger than about 10 nm will not. Alternatively, in solvents such as xylene or toluene, larger nanoparticles will still be soluble. According to an additional aspect of the present invention, when the size distribution of rhenium nanoparticles 502 is large enough (or if more than one narrow size range of rhenium nanoparticles is present), some nanoparticles may be dissolved in the solvent, while others form a slurry therewith.

The ability of some solvents to dissolve smaller rhenium nanoparticles than others can be exploited to separate nanoparticles of different sizes, in accordance with one embodiment of the present invention. For example, by introducing the rhenium nanoparticles into a hexane solvent, nanoparticles larger than 10 nm (i.e., those that do not dissolve in hexane) can be separated from nanoparticles smaller than 10 nm (i.e., those that do dissolve in hexane). These larger particles can then be introduced into a different solvent, such as xylene or toluene, to again separate smaller and larger particles (depending upon their solubility in this solvent). A third fraction of the nanoparticles can similarly be separated out by size in yet another solvent such as isopropyl alcohol ("IPA"). Nanoparticles (and agglomerates thereof) which are larger than about 100 nm will not dissolve well in any known organic solvent with low polarity.

In accordance with one aspect of the present invention, rhenium nanoparticle mixture 500 may include rhenium nanoparticles 502 of a variety of sizes. For example, rhenium nanoparticles 502 may have a single, continuous particle size distribution, as a result of all the nanoparticles being created in a single reaction. Alternatively, rhenium nanoparticles 502 may have multiple non-continuous particle size distributions (e.g., as a result of mixing nanoparticles produced in separate reactions), where some of the nanoparticles are smaller (e.g. between 4 nm and 10 nm), and the remainder of the particles are larger (e.g., between 25 nm and 100 nm). This arrangement may be particularly desirable for increasing the volumetric packing efficiency of rhenium nanoparticles in a rhenium coating, as discussed in greater detail below. It will be immediately apparent to one of skill in the art that the foregoing embodiments are merely exemplary, and that the present invention has application to rhenium nanoparticle mixtures with any size rhenium nanoparticles with any particle size distributions.

In accordance with one aspect of the present invention, rhenium nanoparticle mixture 500 can be "painted" onto surfaces to form thin rhenium coatings. This is accomplished by disposing rhenium nanoparticle mixture 500 onto a surface to be coated, and heating the "painted" mixture with progressively higher temperatures to (1) boil off the solvent, (2) boil off the surfactant and (3) "fuse" adjacent rhenium nanoparticles together. This process is described in greater detail below, with respect to FIG. 6.

Figure 6:
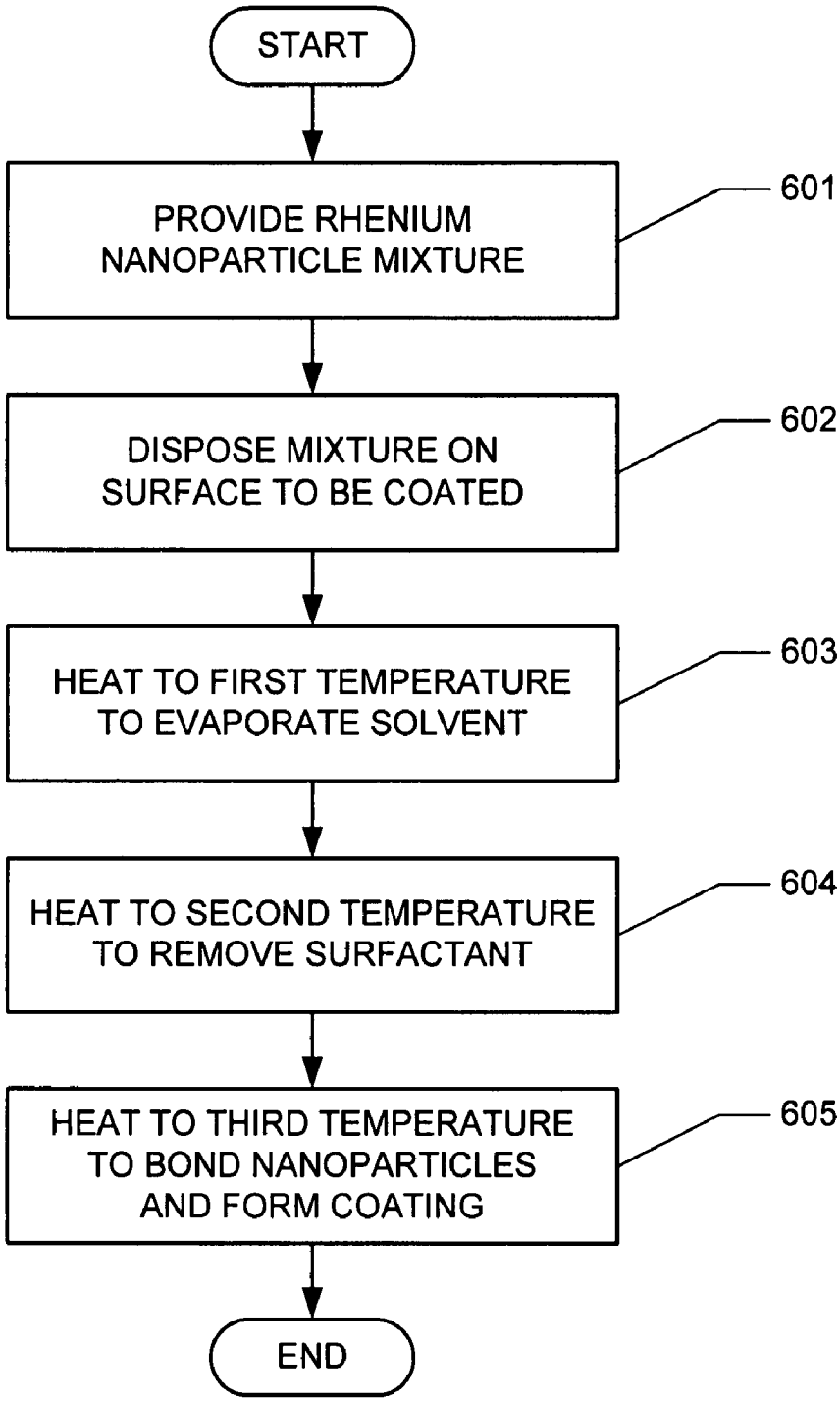
FIG. 6 is a flowchart illustrating a method for forming a rhenium coating in accordance with one embodiment of the present invention.

FIG. 6 is a flowchart illustrating a method for forming a rhenium coating in accordance with one embodiment of the present invention. The method begins with step 601, in which a rhenium nanoparticle mixture is provided. The rhenium nanoparticle mixture includes a solvent and a plurality of rhenium nanoparticles, each surrounded by a layer of surfactant molecules, as in, e.g., rhenium nanoparticle mixture 500. In step 602, the rhenium nanoparticle mixture is disposed on a surface to be coated. In accordance with one important aspect of the present invention, the surface to be coated need not be capable of withstanding the very high temperatures associated with most metallurgical approaches to coating a surface with rhenium. For example, the surface to be coated may be a carbon-based material, such as graphite or a carbon/carbon ("C/C") composite. In step 603, the coated surface is heated to a first temperature to evaporate the solvent from the rhenium nanoparticle mixture, leaving the coated rhenium nanoparticles arranged in a lattice on the surface. In the present exemplary embodiment, the first temperature is chosen to be a temperature sufficiently high to evaporate the solvent, but not high enough to evaporate the surfactant layer around in each molecule. For example, in an embodiment in which the solvent in the rhenium nanoparticle mixture is hexane, and in which the surfactant molecules are hexylamine molecules, the first temperature may be between 125° C. and 175° C.

Figure 7:
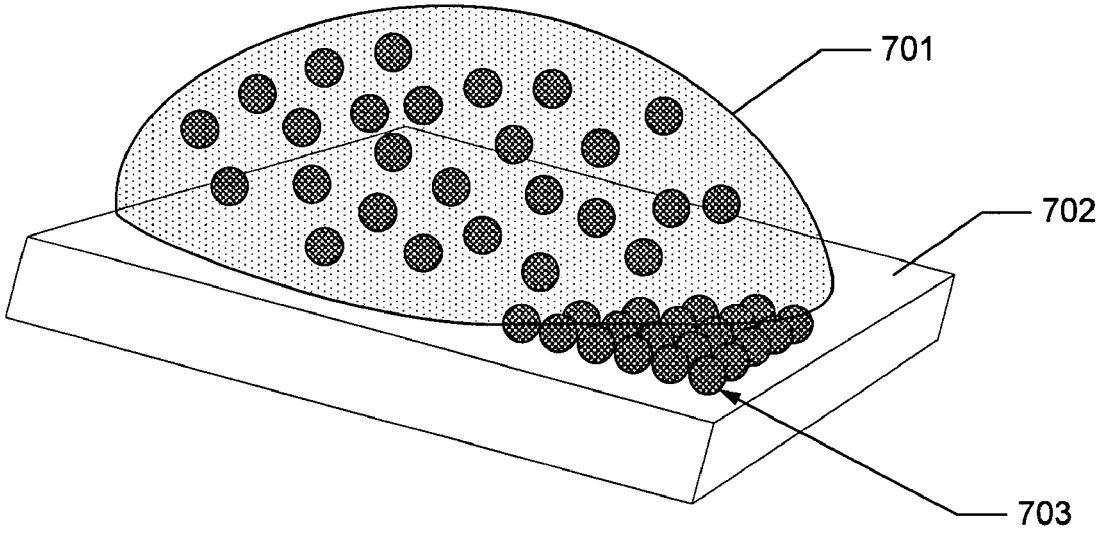
FIG. 7 illustrates the formation of a rhenium coating in accordance with one embodiment of the present invention.

Turning briefly to FIG. 7, the first heating step 603 is illustrated in greater detail in accordance with one embodiment of the present invention. In FIG. 7, the rhenium nanoparticle mixture 701, which has been disposed on surface 702, is beginning to evaporate, leaving rhenium nanoparticles 703 arranged on surface 702.

According to one aspect of the present invention, the fashion with which the nanoparticles arrange themselves on the surface depends upon the surfactant with which they are coated. In this regard, rhenium nanoparticles coated with amines will usually yield hexagonal 2D arrays, whereas thiols tend to form tape- and wire-like structures. However, the nature of the nanoparticle does play a role as well, which is not well understood at this time.

Returning to FIG. 6, the process continues with step 604, in which the coated surface is heated to a second temperature to remove the surfactant layers from around the rhenium nanoparticles. In accordance with the present exemplary embodiment of the invention, in which the surfactant is hexylamine, the second temperature is between about 200° C. and 300° C. In removing the surfactant molecules, this second heating step effects a volumetric contraction of the lattice of rhenium nanoparticles.

Depending upon the surfactant (or combination of surfactants) present in the rhenium nanoparticle mixture, the volume of the coated rhenium nanoparticles may be significantly larger than the uncoated rhenium nanoparticles left after second heating step 604. For example, in accordance with the present exemplary embodiment, in which the (single) surfactant used is hexylamine, the volume of the rhenium nanoparticles contracts by about 17% after the second heating step. Accordingly, in choosing a surfactant (or combination of surfactants) to use in preparing a rhenium nanoparticle mixture, those which provide a lesser volumetric contraction during this step may be desirable to reduce cracking of the resultant rhenium coating, in accordance with one aspect of the present invention. This contraction is illustrated in greater detail in FIGS. 8A and 8B, in accordance with one embodiment of the present invention.

Figure 8A:
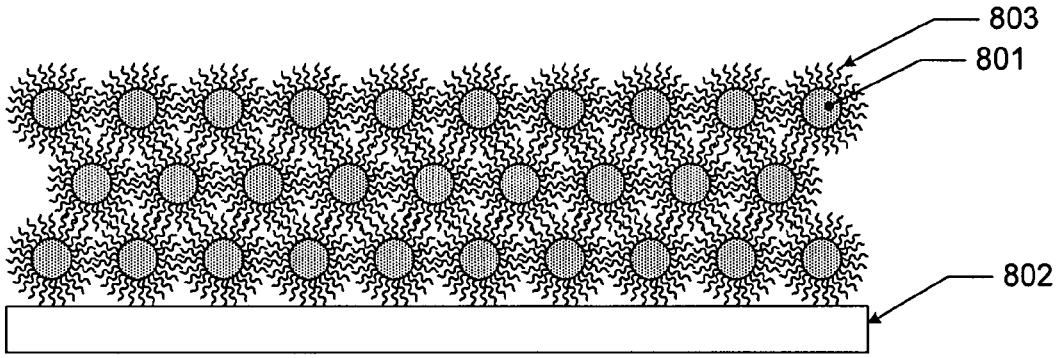
FIGS. 8A, 8B and 8C illustrate the formation of a rhenium coating in accordance with one embodiment of the present invention.
Figure 8B:
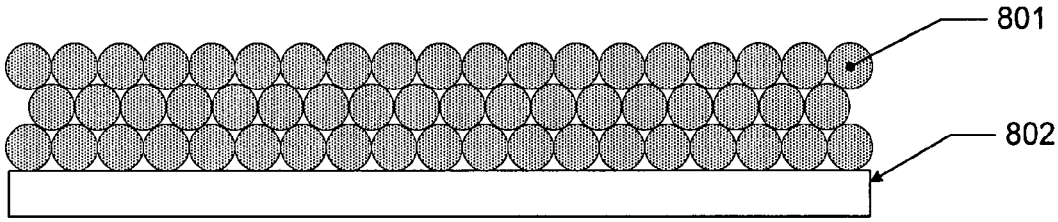

FIG. 8A illustrates an orderly lattice of surfactant-covered rhenium nanoparticles 801 disposed on a surface 802. As can be seen with reference to FIG. 8A, the surfactant molecules 803 space the rhenium cores of the rhenium nanoparticles a significant distance apart. Once these particles are heated to the second temperature of step 604, the surfactant molecules 803 are removed, and rhenium nanoparticles 801 contract in their absence, as illustrated in FIG. 8B. Depending upon the surfactant or surfactants used, this contraction may be significant enough to form cracks in the rhenium coating on surface 802. For example, the removal of longer surfactant molecules (e.g., with carbon chains longer than C16) may cause the rhenium nanoparticles to contract to such an extent, that the rhenium coating spalls and flakes off of surface 802.

While FIGS. 8A and 8B illustrate an embodiment of the present invention in which rhenium nanoparticles 801 are all approximately the same size (i.e., they have a very narrow particle size distribution), the scope of the present invention is not limited to such an arrangement. Rather, the present invention has application to rhenium nanoparticle coatings in which rhenium nanoparticles of different sizes are used to improve the packing efficiency thereof. For example, in accordance with one embodiment of the present invention, rhenium nanoparticles of two approximate sizes may be provided in a rhenium nanoparticle mixture, where the smaller nanoparticles are approximately 10% of the volume of the larger particles, to provide greater spherical packing efficiency (wherein the smaller particles occupy the interstitial spaces between the larger particles in the lattice). Other arrangements with different particle size distributions may also be provided, to further improve packing efficiency and crack resilience, within the scope of the present invention.

Figure 9:
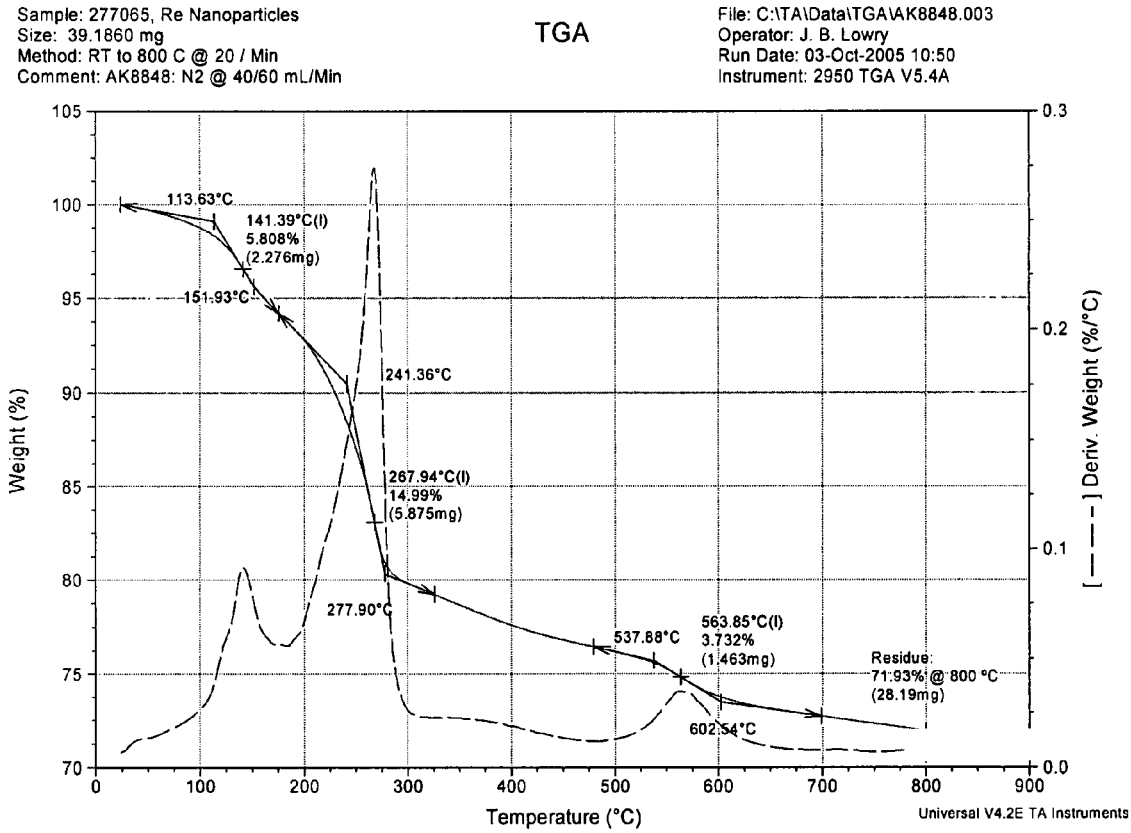
FIG. 9 is a graph illustrating the results of a thermogravimetric analysis ("TGA") of rhenium nanoparticles manufactured in accordance with one embodiment of the present invention.

Turning momentarily to FIG. 9, the evaporation of the solvent and the removal of the surfactant which occur in steps 603 and 604, respectively, are illustrated in accordance with one embodiment of the present invention. FIG. 9 illustrates the results of a thermogravimetric analysis ("TGA") of a sample of rhenium nanoparticles manufactured in accordance with one embodiment of the present invention. As can be seen with reference to FIG. 9, the mass of the nanoparticles is seen to decrease with the increasing temperature of steps 603 and 604. Three significant mass reducing events can be seen at about 141° C., 268° C. and 564° C., corresponding to the evaporation of the solvent, the removal of the surfactant, and oxidation of some residual carbon due to some surfactant trapping.

While in the foregoing exemplary embodiment, the evaporation of the solvent has been described as occurring prior to the removal of the surfactant, the scope of the present invention is not limited to such an arrangement. Rather, depending upon the surfactants and solvents used in the rhenium nanoparticle coating process, one or more surfactants may be removed prior to, or at the same time as, one or more of the surfactants used. Thus, in accordance with various embodiments of the present invention steps 603 and 604 may occur in any order, or may be combined in to a single step, in which the first and second temperature are one and the same.

Figure 8C:
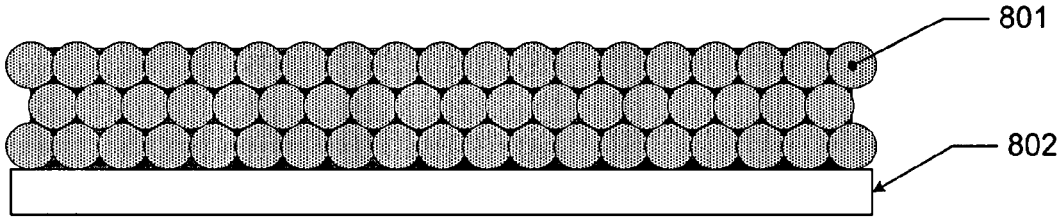
Figure 10:
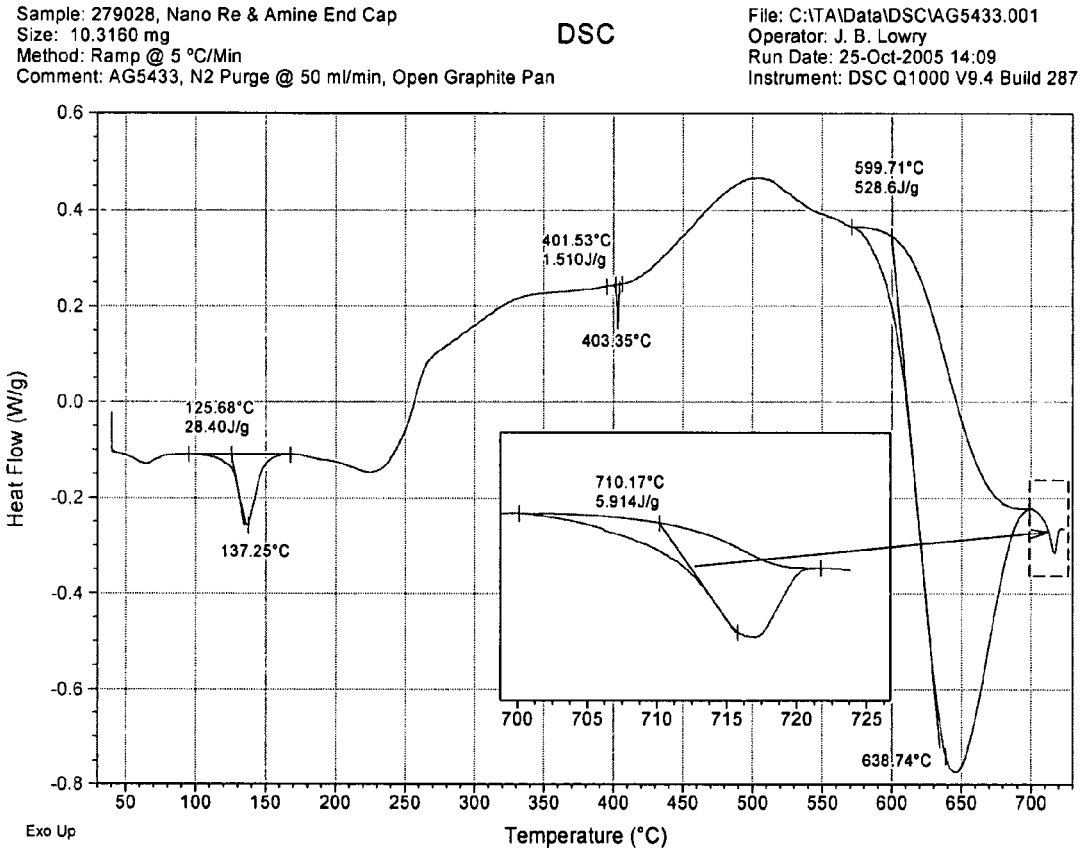
FIG. 10 is a graph illustrating the results of a differential scanning calorimetry ("DSC") analysis of rhenium nanoparticles manufactured in accordance with one embodiment of the present invention.

Returning to FIG. 6, the process continues with step 605, in which the coated surface is heated to a third temperature to bond the rhenium nanoparticles together to form a coating on the surface. In accordance with the present exemplary embodiment of the invention, the third temperature is between about 550° C. and 700° C. This temperature "fuses" or bonds the adjacent rhenium nanoparticles to each other, to form a coherent coating of rhenium on the substrate. This bonding is illustrated in FIG. 8C, in which rhenium nanoparticles 801 have bonded as a result of the application of the third temperature. The effect is also illustrated in FIG. 10, in which the results of a differential scanning calorimetry ("DSC") analysis are illustrated in graph form, in accordance with one embodiment of the present invention. As can be seen with reference to FIG. 10, a strongly endothermic event begins at about 600° C., with a maximum at abound 645° C., which is believed to correspond to the adjacent rhenium nanoparticles entering a more energetically favorable bonded state.

The foregoing temperatures used to form the rhenium coating are well below those necessary to form rhenium coatings using other approaches. Accordingly, an important advantage of the present invention is the ability to form rhenium coatings on materials not previously capable of being coated with rhenium. For example, in accordance with various embodiments of the present invention, the foregoing method can be used to coat carbon-based materials (e.g., graphite, carbon/carbon composites) and other temperature sensitive materials (e.g., materials that would melt, oxidize, or otherwise not withstand temperatures above 800° C.). Of course, as will be understood by those of skill in the art, the present invention has application to coating a wide range of materials, including molybdenum (Mo) and tungsten (W), which would greatly benefit from a more oxidation resistant rhenium coating.

Additionally, the simplicity of "painting" on a rhenium nanoparticle mixture allows shapes not previously capable of being coated with rhenium to be coated using the foregoing methods, in accordance with yet other embodiments of the present invention. For example, internal surfaces of complex shapes (e.g., the inner diameter of tubes or nozzles), as well as high-aspect ratio surfaces, can be coated with a rhenium nanoparticle coating, in accordance with various embodiments of the present invention.

According to one aspect of the present invention, a benefit enjoyed by this bonded nanoparticle structure may be an increased pseudo-ductility, resulting from the ability of each nanoparticle to translate with respect to adjacent nanoparticles in the structure. In one exemplary experiment, a bonded rhenium microparticle structure was compression tested and deformed under a nominal 5,000 psi load at between 1850° C. and 1900° C. for about 15 minutes. Prior to deformation, the rhenium material possessed a fine, equiaxed grain microstructure. After deformation, the equiaxed microstructure remained, indicating that the grains or nanoparticles in the material were able to translate and/or rearrange themselves during the compression testing, unlike rhenium materials formed from powder metallurgy, which lose their equiaxed microstructure when subjected to the same test.

Figure 11:
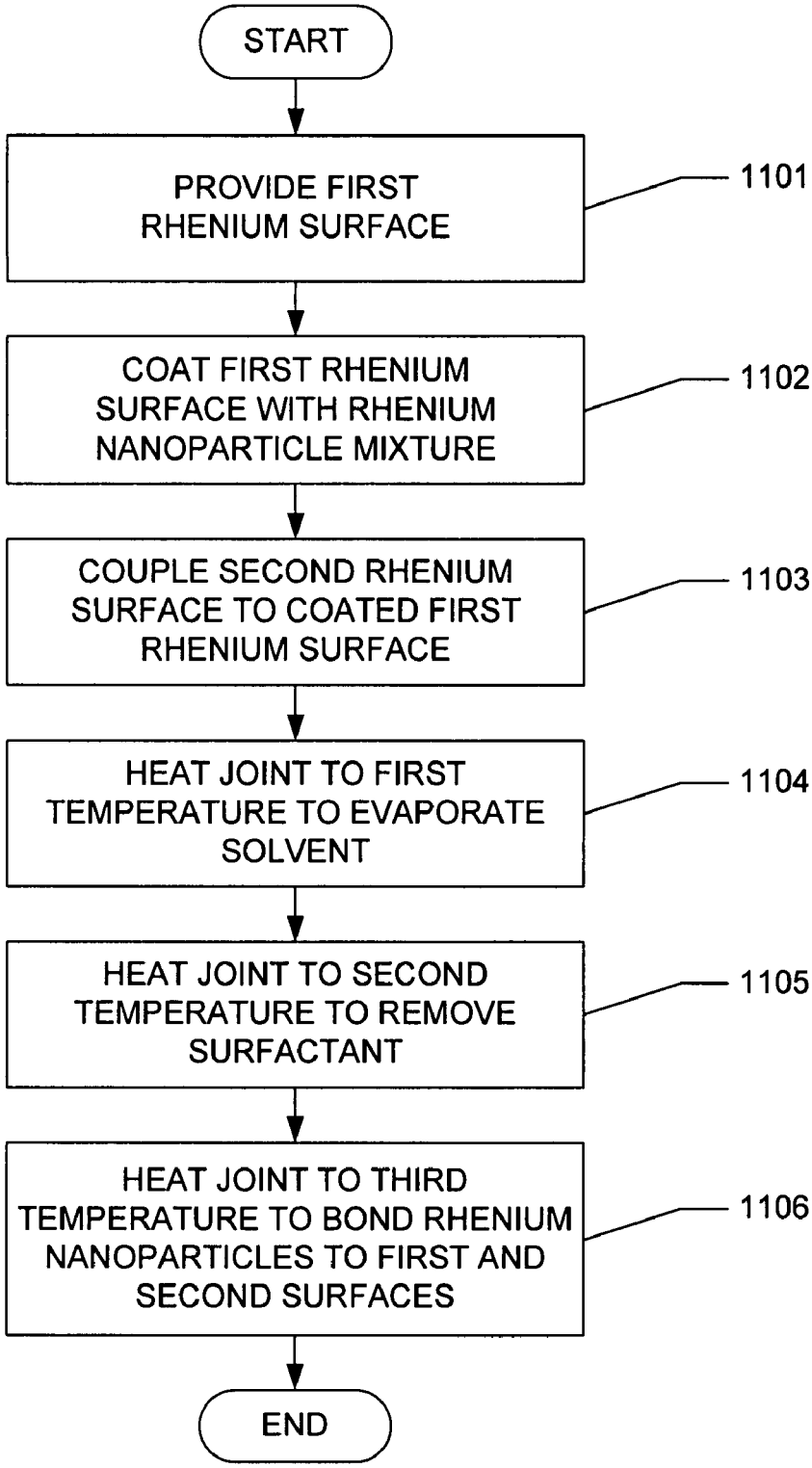
FIG. 11 is a flowchart illustrating a method for rhenium welding in accordance with one embodiment of the present invention.

FIG. 11 is a flowchart illustrating a method for welding rhenium in accordance with one embodiment of the present invention. The method begins with step 1101, in which a first rhenium surface is provided. In step 1102, the first rhenium surface is coated with a rhenium nanoparticle mixture. The rhenium nanoparticle mixture includes a solvent and a plurality of rhenium nanoparticles, each of which is surrounded by a layer of surfactant molecules. In step 1103, a second rhenium surface is coupled to the coated first rhenium surface to form a joint. In step 1104, the joint is heated to a first temperature to evaporate the solvent, as described in greater detail above with respect to FIG. 6. In step 1105, the joint is heated to a second temperature to remove the surfactant molecules, as described in greater detail above with respect to FIG. 6. In step 1106, the joint is heated to a third temperature to bond the rhenium nanoparticles to the first rhenium surface and the second rhenium surface.

While in the foregoing description, the nanoparticles have been described with reference to elemental rhenium, the scope of the present invention is not limited to such an arrangement. Rather, the present invention has application to nanoparticles made of elemental iridium (Ir), or of an alloy or rhenium and iridium.

While the present invention has been particularly described with reference to the various figures and embodiments, it should be understood that these are for illustration purposes only and should not be taken as limiting the scope of the invention. There may be many other ways to implement the invention. Many changes and modifications may be made to the invention, by one having ordinary skill in the art, without departing from the spirit and scope of the invention.

What is claimed is:

1. A method for manufacturing rhenium nanoparticles, the method comprising the steps of:

providing an ethylene oxide solvent;

providing a rhenium precursor, the rhenium precursor including rhenium and one or more additional elements;

providing a reactant for reacting with the rhenium precursor to free the rhenium from the one or more additional elements;

providing a surfactant; and combining the rhenium precursor, the reactant and the surfactant in the ethylene oxide solvent to form a plurality of rhenium nanoparticles and to surround each rhenium nanoparticle with a layer of molecules of the surfactant.

2. The method according to claim 1, wherein the rhenium precursor is ReCl5.

3. The method according to claim 1, wherein the reactant is NaBH4 or LiBH(Et)3.

4. The method according to claim 1, wherein the ethylene oxide solvent is characterized by the chemical formula CH3O (CH2CH2O)xCH3, where x is a positive integer.

5. The method according to claim 1, wherein the surfactant is an amine characterized by the chemical formula CH3 (CH2)xNH2, where x is a positive integer.

6. The method according to claim 5, wherein the surfactant is selected from the group consisting of n-hexylamine (CH3 (CH2)5NH2), n-nonylamine (CH3(CH2)8NH2) and n-dodecylamine (CH3(CH2)11NH2).

7. The method according to claim 1, wherein the surfactant is oleic acid.

8. The method according to claim 1, wherein the combining step includes controlling a temperature of the ethylene oxide solvent to control an average size of the plurality of rhenium nanoparticles.

9. The method according to claim 1, further comprising the step of providing a second surfactant, and wherein then combining step further includes combining the second surfactant with the rhenium precursor, the reactant and the surfactant in the ethylene oxide solvent.

10. The method according to claim 1, wherein an average diameter of the plurality of rhenium nanoparticles is less than 15 nanometers.

11. The method according to claim 1, wherein an average diameter of the plurality of rhenium nanoparticles is between 15 and 100 nanometers.

12. The method according to claim 1, wherein the plurality of rhenium nanoparticles are formed in an amount greater than 50 grams per liter of the ethylene oxide solvent.

13. A method for manufacturing rhenium nanoparticles, the method comprising the steps of:

providing an ethylene oxide solvent;

in the ethylene oxide solvent, reacting a rhenium precursor and a reactant to free a plurality of rhenium atoms from the rhenium precursor;

in the ethylene oxide solvent, combining the plurality of rhenium atoms to form a rhenium nanoparticle; and in the ethylene oxide solvent, surrounding the rhenium nanoparticle with a layer of surfactant molecules.

14. The method according to claim 13, wherein the rhenium precursor is ReCl5.

15. The method according to claim 13, wherein the reactant is NaBH4 or LiBH(Et)3.

16. The method according to claim 13, wherein the ethylene oxide solvent is characterized by the chemical formula CH3O(CH2CHO)xCH3, where x is a positive integer.

17. The method according to claim 13, wherein the surfactant is an amine characterized by the chemical formula CH3 (CH2)xNH2, where x is a positive integer.

18. The method according to claim 13, wherein the surfactant is oleic acid.

19. The method according to claim 13, further comprising the step of controlling a temperature of the ethylene oxide solvent to control a size of the rhenium nanoparticle.

20. The method according to claim 13, wherein the surfactant includes a first surfactant and a second surfactant, and wherein the surrounding step includes surrounding the rhenium nanoparticle with a layer including molecules of the first surfactant and molecules of the second surfactant.

21. The method according to claim 13, wherein the rhenium nanoparticle has a diameter of less than 15 nanometers.

22. A method for manufacturing nanoparticles, the method comprising the steps of:

providing an ethylene oxide solvent;

providing a precursor including one or more of rhenium and iridium, the precursor further including one or more additional elements other than rhenium and iridium;

providing a reactant for reacting with the precursor to remove the one or more additional elements;

providing a surfactant; and combining the precursor, the reactant and the surfactant in the ethylene oxide solvent to form a plurality of nanoparticles and to surround each nanoparticle with a layer of molecules of the surfactant.

* * * * *